United States Patent [19]

Morrone

[11] 4,417,729

[45] Nov. 29, 1983

[54] RACKET STRINGING APPARATUS

[75] Inventor: Ross F. Morrone, Jamesburg, N.J.

[73] Assignee: Prince Manufacturing, Inc., Princeton, N.J.

[21] Appl. No.: 352,820

[22] Filed: Feb. 26, 1982

[51] Int. Cl.[3] ..... A63B 51/14

[52] U.S. Cl. ..... 273/73 A

[58] Field of Search ..... 273/73 A; 269/242

[56] References Cited

U.S. PATENT DOCUMENTS

| | | | |
|---|---|---|---|
| 1,618,532 | 2/1927 | Hildemann | 273/73 A |
| 1,877,787 | 9/1932 | Argabrite . | |
| 1,943,400 | 1/1934 | Tauber et al. | 273/73 A |
| 1,945,043 | 1/1934 | Jaffe | 273/73 A |
| 1,962,865 | 6/1934 | Goodhall et al. | 273/73 A |
| 1,969,826 | 8/1934 | Tauber et al. | 273/73 A |
| 1,989,002 | 1/1935 | Doll | 273/73 A |
| 2,014,989 | 9/1935 | Sieff | 273/73 A |
| 2,043,813 | 6/1936 | Saladino | 273/73 A |
| 2,091,654 | 8/1937 | Roberts et al. | 273/73 A |
| 2,100,948 | 11/1937 | Doll | 273/73 A |
| 2,154,870 | 4/1939 | Serrano | 273/73 A |
| 2,188,250 | 1/1940 | Serrano | 273/73 A |
| 2,246,109 | 6/1941 | Serrano | 273/73 A |
| 2,262,110 | 11/1941 | Mineck | 273/73 A |
| 2,309,849 | 2/1943 | Kausal et al. | 273/73 A |
| 2,389,609 | 11/1945 | Caro et al. | 273/73 A |
| 2,826,065 | 3/1958 | Grimes . | |
| 2,971,760 | 2/1961 | Boykin et al. | 273/73 A |
| 3,441,275 | 4/1969 | Held | 273/73 A |
| 3,635,080 | 1/1972 | Krueger | 273/73 A |
| 3,823,609 | 6/1974 | Miyagawa et al. | 273/73 A |
| 3,913,912 | 10/1975 | Smith | 273/73 A |
| 4,049,268 | 9/1977 | Ray | 273/73 A |
| 4,130,278 | 12/1978 | Gutzwiller | 273/73 A |
| 4,156,525 | 5/1979 | Parnell | 273/73 A |
| 4,249,732 | 2/1981 | Balaban | 273/73 A |

FOREIGN PATENT DOCUMENTS

| | | | |
|---|---|---|---|
| 314595 | 7/1929 | United Kingdom | 273/73 A |
| 486825 | 7/1938 | United Kingdom . | |
| 528985 | 11/1940 | United Kingdom | 273/73 A |

*Primary Examiner*—Richard C. Pinkham
*Assistant Examiner*—Matthew Schneider
*Attorney, Agent, or Firm*—Seidel, Gonda & Goldhammer

[57] ABSTRACT

A racket stringing apparatus having a racket frame clamp assembly pivotably mounted to a base. The racket frame clamp assembly includes support arms for carrying the frame clamps. The support arms are such that they allow the clamps to be self-centering with respect to the vertical axis of the base. A tension head assembly is mounted on a beam that is also connected to the base. The tension head assembly is capable of reciprocating movement along the beam. When a sufficient initial tension is placed on the strings, a portion of the tension head assembly is locked in place by a brake. The brake forces the tension head assembly to pivot and this pivoting action automatically actuates a driving means that applies and maintains a predetermined final tension on the string.

22 Claims, 7 Drawing Figures

RACKET STRINGING APPARATUS

BACKGROUND OF THE INVENTION

This invention relates to a racket stringing apparatus used for stringing tennis rackets, racquetball rackets, squash rackets, badminton rackets, and the like.

More particularly, the present invention relates to a racket stringing apparatus in which continuous tension is applied and maintained on the strings as they are being strung by an active driving device, such as a pneumatic system, a hydraulic system, a solenoid or other electromagnetic system, an electric motor, or other actively powered device. This type of apparatus has advantages over currently available racket stringing devices using springs or weights in an attempt to maintain a preset tension on a string.

Typical stringing machines using weights in an effort to maintain the preset string tension are disclosed, for example, in U.S. Pat. Nos. 2,188,250 of Serrano, issued Jan. 23, 1940, 2,246,109 of Serrano, issued June 17, 1941, 2,389,609 of Caro et al., issued Nov. 27, 1945 and 4,130,278 of Gutzwiller, issued Dec. 19, 1978. Machines in which the tension is to be maintained by weights are disadvantageous because they are bulky and cumbersome to use and it takes a comparatively long time for the string to be elongated and maintained in the elongated condition at the appropriate tension.

Typical examples of machines using springs in an attempt to maintain the proper preset string tension are those disclosed in U.S. Pat. Nos. 2,043,813 of Saladino, issued June 9, 1936, 2,091,654 of Roberts et al., issued Aug. 31, 1937, 2,154,870 of Serrano, issued Apr. 18, 1939, 3,441,275 of Held, issued Apr. 29, 1969, 3,823,609 of Miyagawa et al., issued July 16, 1974, and 4,249,732 of Balaban, issued Feb. 10, 1981.

The uniformity of the tension which can be applied to racket strings springs in these machines is affected by such factors as spring wear, wear of the spring seats, and temperature.

It is believed that racket stringing devices in which the tension on the string is maintained by an active or driven tensioning device, as opposed to passive tensioning devices, such as springs or weights, provide a more uniform, positive and accurate tensioning of the string and are able to maintain the tension on the string more effectively than the passive tensioning devices. Examples of stringing apparatus using active tensioning means include U.S. Pat. Nos. 2,100,948 of Doll, issued Nov. 30, 1937, 2,309,849 of Kausal et al., issued Feb. 2, 1943, 3,635,080 of Krueger, issued Jan. 18, 1972, and 3,913,912 of Smith, issued Oct. 21, 1975. U.S. Pat. No. 1,877,787 of Argabrite, issued Sept. 20, 1932, shows the use of a plurality of hydraulic or pneumatic cylinders movably mounted on several bases at the corner of a leather stretching apparatus. This patent is not believed to be analagous to the present invention, but is mentioned for the purpose of complying with the requirements for a full disclosure.

The hydraulically driven or pneumatically driven stringing machines known to the inventor are generally bulky, difficult to assemble and manufacture and are complicated in operation.

The present invention has been designed to overcome the problems of the prior art and to allow even unskilled racket stringers to produce properly strung rackets having uniform string tension using apparatus which is easy to operate and which uniformly and continuously maintains a predetermined tension on a string during the entire racket stringing process.

The present invention includes performance characteristics which have the following advantages: minimization or elimination of operator error, racket frame distortion, string elongation in a strung racket, frictional losses of string on string and string on the frame, off-center pulling of the string, structural deflection of the stringing apparatus and the string clamps, and lack of uniformity and repeatability of string tensioning.

The present invention also has the advantages that it will not mar or scratch the racket frame, allows maximum string hole access, adaptability to a racket frame head having any radius of curvature, allows sufficient frame flexure to accomodate the tension applied to the frame head by the string during the stringing process, allows rapid frame mounting and removal, and other advantages which will be apparent to those skilled in the art after considering the following description.

The present invention broadly includes several novel structures, systems and features for achieving the desired result of properly strung rackets having the proper string tension and which are capable of maintaining the desired string tension because of the way the rackets were strung.

One such system is the tensioning system which provides an active tensioning drive means which is actuated automatically after a sufficient initial tension is placed on the string. A brake locks a portion of a tension head assembly and cooperates with the drive means for applying and maintaining a predetermined tension on the string.

Another novel feature of the present invention is the racket frame clamp assembly. The racket frame clamp assembly of the present invention includes adjustable frame clamp support arms carrying the frame clamps to allow the clamps to be self-centering with respect to the vertical axis of the base of the stringing apparatus. This vertical axis is designed to correspond with the center of the racket head so that minimum frame distortion and string friction occur, while at the same time providing maximum control and convenience for the operator, including allowing the operator to slightly prestress the unstrung racket frame.

Still another novel structural system developed for the present invention relates to the racket frame head clamp adjacent the tip portion of the racket. This structure provides for positive retention of a racket frame and further minimizes head distortion during stringing. It enables the racket to be firmly, yet quickly clamped in and removed from the racket frame clamp assembly.

SUMMARY OF THE INVENTION

One aspect of the present invention is a racket stringing apparatus comprising:

(a) a base, (b) a racket frame clamp assembly pivotably mounted on the base and adapted to clamp a racket to be strung, (c) a tension head support beam having a first end and a second end, the first end of the beam being mounted on the base, (d) a tension head assembly mounted for reciprocating movement along the beam and for limited pivotable movement about an axis transverse to the beam and transverse to the plane of the tension head assembly and adjacent a lower portion of the tension head assembly closest to the first end of the beam, (e) driving means for continuously maintaining a predetermined tension on a string with which the racket is to be strung, (f) means for regulating the tension on a string, and (g) means for indicating the tension on the string, the tension head assembly including a body, means for reciprocating the tension head assembly along the beam, locking means for locking the tension head assembly against movement along the beam, string gripping means mounted for reciprocating movement along a top portion of the body, the string gripping means being connected to the driving means, whereby when a sufficient initial tension is placed on the string, the tension head assembly pivots about the transverse axis in a first direction toward the first end of the beam, simultaneously causing the locking means to prevent reciprocating movement of the tension head assembly along the beam and further simultaneously activating the driving means to apply and maintain the predetermined tension on the string until the driving means is deactivated.

Another aspect of the present invention comprises a racket frame clamp assembly for use in a racket stringing apparatus having a base, a string tensioning assembly and a racket frame clamp assembly, wherein the racket frame clamp assembly includes a support member mounted for rotational movement about a vertical axis of the base, two support arms mounted on elongated bars for relative reciprocating movement along the length of the bars, frame clamp means mounted on the support arms, and self-centering means operatively associated with the support arms to cause the frame clamp means to be self-centering with respect to the vertical axis of the base.

Still another aspect of the present invention comprises a racket frame head clamp adapted to clamp to a racket stringing machine a head portion of a racket to be strung adjacent a tip portion of the racket, the racket frame head clamp comprising two lower jaws mounted on one end of a lower jaw support having two ends, the lower jaws being spaced apart from each other and adapted to hold the head portion of the racket along its lower inner periphery at locations on opposite sides of the longitudinal axis of the racket, an upper jaw mounted on one end of an upper jaw support having two ends and adapted to hold the head portion of the racket at a location along its upper inner periphery equidistant between the lower jaws, a link having two ends, one end of the link being pivotably connected to the other end of the lower jaw support, the other end of the link being pivotably connected to the other end of the upper jaw support, and screw means associated with the upper and lower jaw supports intermediate the ends thereof operative to move the upper jaw toward the lower jaws to clamp the racket head firmly therebetween.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE PREFERRED EMBODIMENTS

Figure 1:
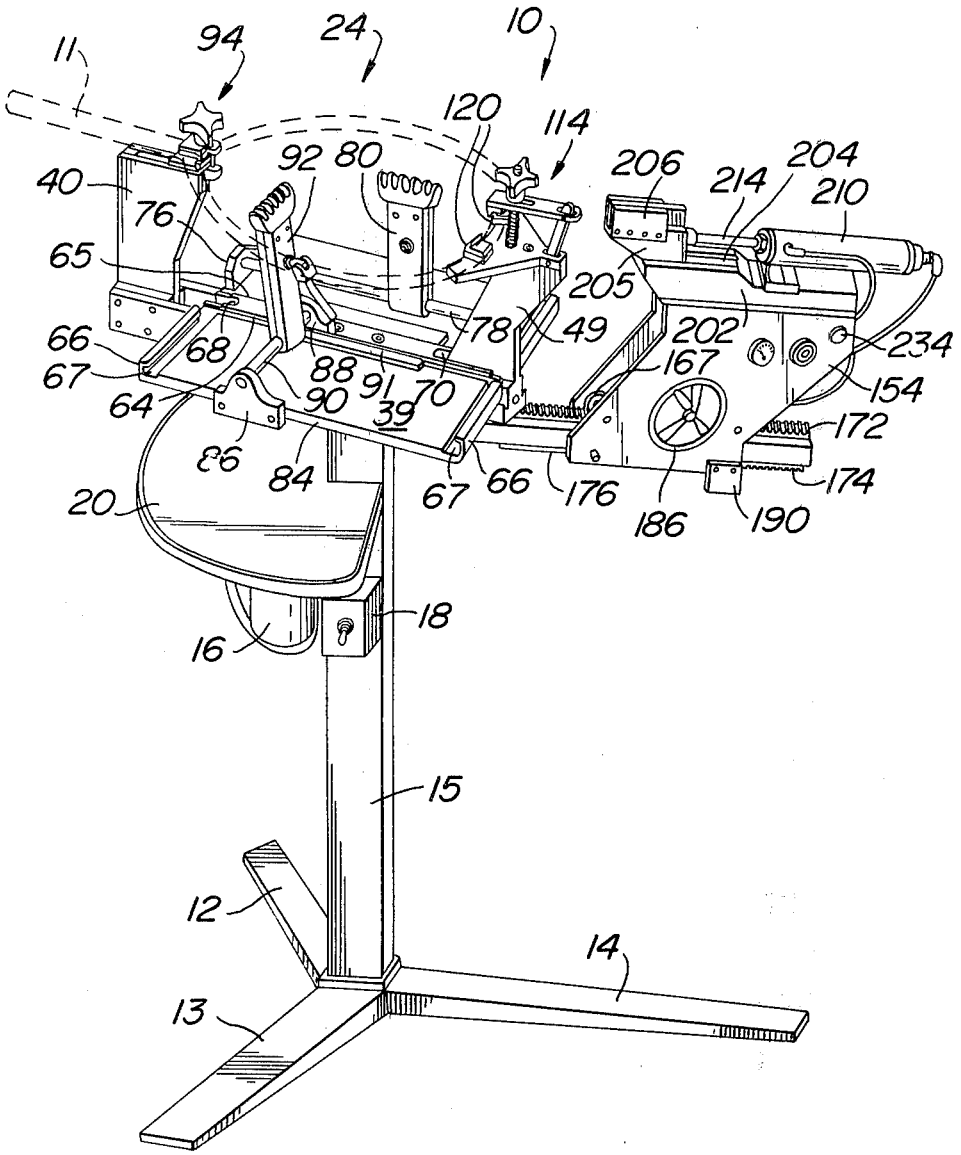
FIG. 1 is a perspective view of a racket stringing apparatus in accordance with the present invention.

Referring to the drawings in detail, wherein like numerals indicate like elements throughout the several views, there is shown in FIG. 1 a racket stringing machine 10 in accordance with the present invention. A racket 11 is illustrated in phantom to generally indicate the orientation of the racket on the racket frame clamp assembly. Stringing apparatus 10 is adapted to string a racket for use in any sport, such as tennis, racquetball, squash, badminton, half-tennis, etc.

Stringing machine 10 has a base including legs 12, 13 and 14 spaced from each other at an angle of about 120°. Leg 14 is longer than legs 12 and 13 and preferably is located directly under the tension head assembly support beam 22 and tension head assembly 150.

The base also includes a vertical support column 15, preferably rectangular and more preferably square in cross-section. A drive means 16 and drive means control box 18 are preferably mounted on column 15. An optional tool table 20 is shown mounted on column 15.

A beam 22 is attached by any suitable means, such as by welding, to column 15. Beam 22 supports a tension head assembly 150. Preferably, beam 22 is a steel tube having a square cross-section and preferably is mounted at right angles to column 15.

A racket frame clamp assembly 24 is mounted on the top of column 15 for rotational movement about the vertical axis of column 15. In addition to being mounted for pivotable movement on column 15, racket frame clamp assembly may be removed easily from column 15 merely by lifting the entire assembly off the column.

Figure 2:
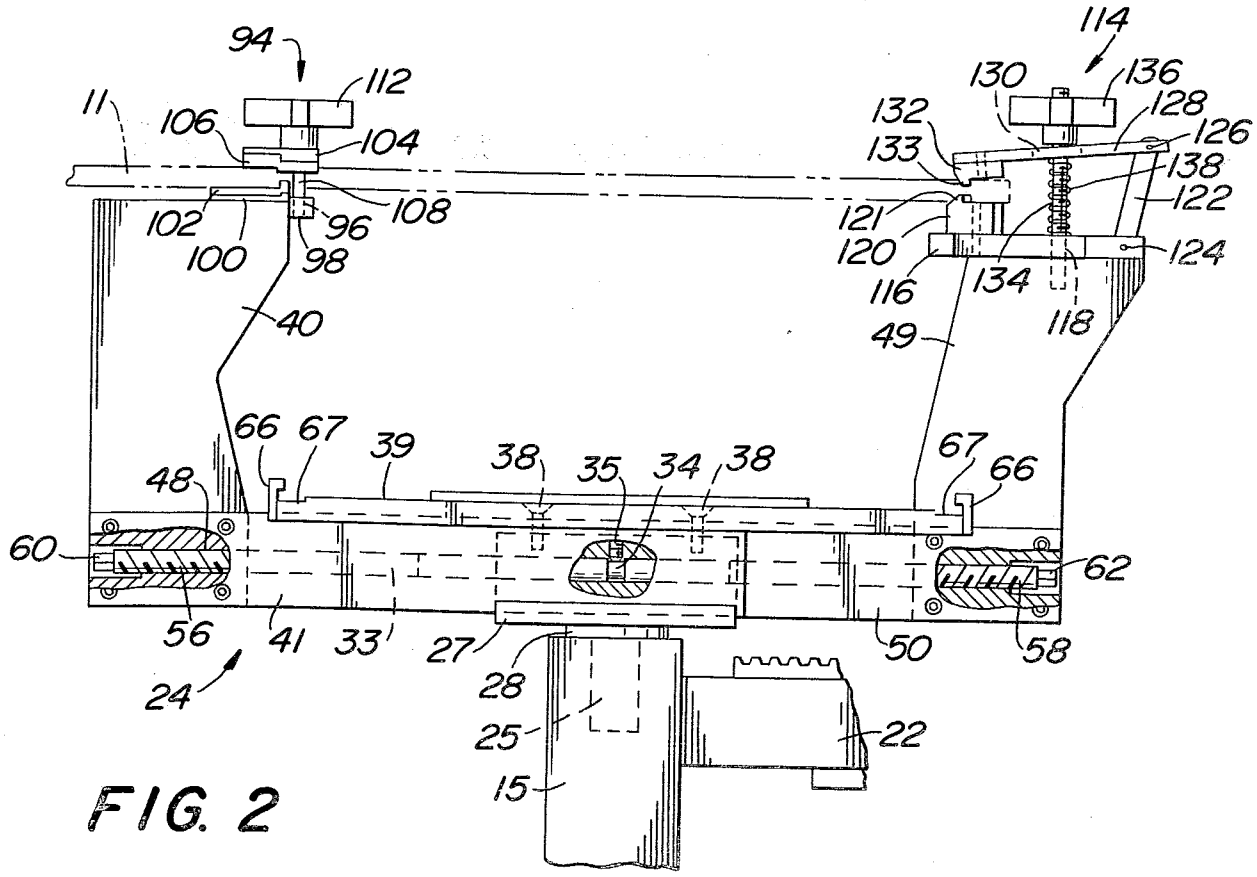
FIG. 2 is a side view, partly in section, of a portion of the apparatus primarily relating to the racket frame clamp assembly.
Figure 3:
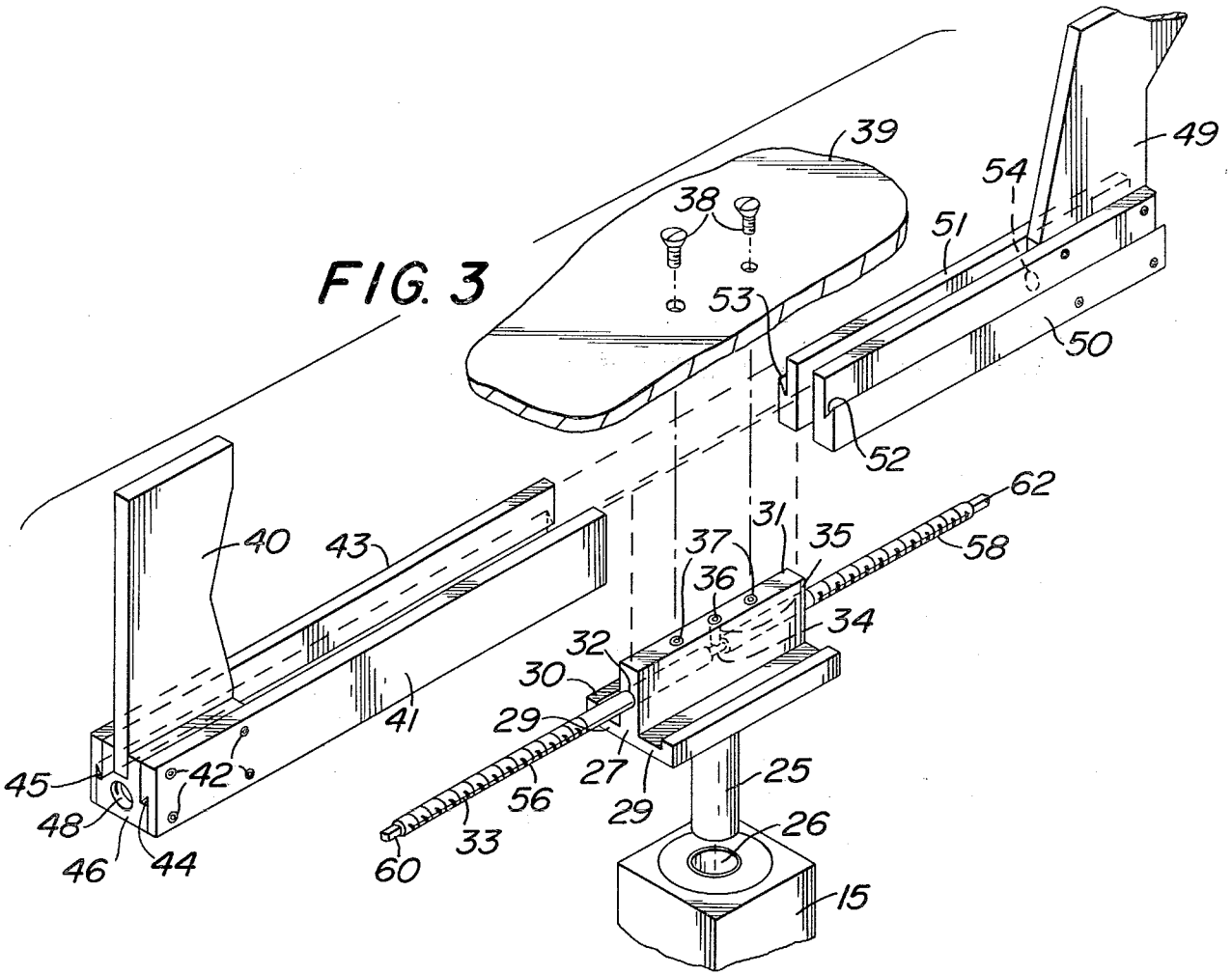
FIG. 3 is a partly exploded perspective view of the racket frame clamp assembly portion of the apparatus illustrated in FIG. 2.

With reference to FIG. 1 and more particularly to FIGS. 2 and 3, racket frame clamp assembly 24 comprises shaft 25 which fits within bore 26 of column 15. Any suitable bushings or bearings may be inserted between shaft 25 and bore 26. Shaft 25 may be integrally formed with or fastened to a support member 27 which supports platform 39 and elongated bars 41, 43, 50 and 51 as described hereinafter. A friction reducing washer 28 is placed over the top of column 15 around shaft 25 to reduce wear and enhance the rotational movement of assembly 24 about the vertical axis of column 15. Washer 28, preferably is made of polymeric plastic such as nylon or DuPont's DELRIN. Support member 27 is preferably a machined metal part having substantially horizontal wings 29. Extending from wings 29 at approximate right angles are flanges 30.

Support member 27 also includes an upright portion 31 through which an unthreaded bore 32 extends. A lead screw 33 having a central portion 34 with a reduced diameter extends through bore 32. A set screw 35 in threaded bore 36 maintains the reduced diameter portion 34 in a position aligned with the vertical axis of column 15.

A platform 39 is mounted on support member 27 by any suitable means, such as screws 38 extending into threaded bores 37.

Racket 11 is mounted in racket frame clamp assembly 24 by frame clamp assemblies 94 and 114 mounted on clamp support arms 40 and 49, respectively. Clamp support arms 40 and 49 are designed for relative reciprocating movement along the axis of lead screw 33 toward and away from each other. Support arms 40 and 49 are also designed to be self-centering with respect to the vertical axis of the base as set forth below.

Support arm 40 is mounted in block 46 between elongated bars 41 and 43 by any suitable means, such as screws 42. Telescoping ways 44 and 45, having a cross-sectional shape of a partial dovetail or a V-shape are formed in bars 41 and 43, respectively, by machining, extrusion or other known processes. A right-hand threaded bore 48 is formed in block 46.

Support arm 49 is fastened to elongated bars 50 and 51 having partial dovetail or inverted V-shaped telescoping ways 52 and 53, respectively. A left-hand threaded bore 54 extends through a lower portion of support arm 49.

As best illustrated in FIGS. 2 and 3, bars 50 and 51 are in an interlocking, cooperating relationship between bars 41 and 43. Telescoping ways 52 and 53 mate or cooperate with and are supported for sliding movement on telescoping ways 44 and 45. Bars 41, 43, 50 and 51 are supported by wing portions 29 of support member 27.

Lead screw 33 includes a right-hand threaded end portion 56 and a left-hand threaded portion 58. The right-hand threaded portion 56 of lead screw 33 is threaded through right-hand threaded bore 48 of support arm 40. The left-hand threaded portion 58 of lead screw 33 is threaded through left-hand threaded bore 54 in support arm 49. The support arms are carefully threaded onto the threaded portions of lead screw 33 so that rotation of the lead screw 33 causes the support arms 40 and 49 to move the same distance in a direction toward and away from the vertical axis of column 15. Lead screw 33 has ends 60 and 62 which have a square or other shape so that lead screw 33 may be conveniently turned by any suitable mating tool.

In the configuration illustrated in FIG. 2, if the end 60 of lead screw 33 is rotated in a clockwise direction (or end 62 is rotated in a counterclockwise direction), support arms 40 and 49 will move away from each other and will move the same distance apart in a direction away from the vertical axis of column 15. Conversely, if end 60 is turned counterclockwise (or end 62 turned counterclockwise), support arms 40 and 49 will move toward each other and will move the same distance in a direction toward the vertical axis of column 15. This allows a self-centering action of the frame clamps 94 and 114 mounted on the arms so that the center of the head of the tennis racket 11 may be centered over the vertical axis of column 15.

This self-centering operation is an important feature of the present invention, since it allows the string to be tensioned at the proper angle so that there will be very little, if any, friction between the string and the string holes. The self-centering feature of the present invention also allows the unstrung racket frame to be slightly prestressed to compensate for the tremendous tension placed upon it by stringing the main strings along the longitudinal axis of the racket before cross-strings are tightened along an axis perpendicular to the longitudinal axis of the racket. This prevents or minimizes frame distortion and eliminates or minimizes areas of local stress along the head of the racket frame.

Although the embodiment illustrated in FIGS. 2 and 3 for the structure providing for the self-centering operation of support arms 40 and 49 is the presently preferred embodiment, other structures may also be used. For example, support arm 40 could be integrally formed with block 46. Further, it is only necessary that each support arm be attached to or integrally formed with one elongated bar, rather than two elongated bars as illustrated in the drawings. Another suitable structure may comprise fastening the bottom portions of the support arms to interlocking telescoping tubes which may be completely or partially cylindrical. Complete dovetail mating means may be used instead of partial dovetail mating means or other sliding joints, such as dado, tongue-in-groove, etc. It is only necessary that the parts have the strength to withstand the forces generated as the string is being tensioned so that the stringing apparatus does not distort and so that the racket frame does not distort.

The racket frame clamp assembly 24 itself is novel and may be adapted for use on other types of racket stringing machines other than stringing machine 10 illustrated and disclosed herein.

Attached to platform 39 are guide flanges 66, preferably in the form of elongated bars having an inverted L-shape cross-section. Guide flanges 66 are mounted on opposite edges of platform 39 by screws or other suitable fastening means. Alternately, guide flanges 66 may be integrally formed with platform 39.

The upper surface of platform 39 contains channels 67 milled or otherwise formed therein along the edges adjacent to guide flanges 66. Slots 68 and 70 are formed in the platform 39 to allow movement of support arms 40 and 49 toward and away from the vertical axis of column 15.

String clamp glide rod supports 76 are removably mounted for reciprocating movement along guide flanges 66 within channels 67. String clamp glide rod supports 76 (only one of which is illustrated in FIG. 1 for the sake of clarity) are made of nylon, DuPont's DELRIN, or other suitable material preferably having a low coefficient of friction. A string clamp glide rod 78 is mounted within supports 76. Mounted on rod 78 is a conventional string clamp 80. String clamp 80 is adapted to hold a string taut at the proper tension between the teeth formed along its upper end after the string has been properly tensioned by the string tensioning apparatus. Although only one string clamp 80 and the supporting structure therefor is illustrated in FIG. 1 for the sake of clarity, another such string clamp and supporting structure may be mounted on platform 39 and arranged for generally parallel movement with string clamp 80. String clamp 80 is adapted to clamp the main strings of the racket.

Channels 64 and 65 are milled into or otherwise formed on the upper surface of platform 39 as illustrated in FIG. 1. Guide bars 91 are fastened to or integrally formed with platform 39 adjacent to and parallel to channels 64 and 65. String clamp glide rod support 86 overlaps edge 84 of platform 39 for reciprocating movement therealong. String clamp glide rod support 88 rides along guide bar 91 in channel 64. A string clamp glide rod 90 is mounted between supports 86 and 88. String clamp 92 is mounted for reciprocating movement along glide rod 90. Although one clamp 92 is illustrated for purposes of clarity in FIG. 1, other similar string clamps and the corresponding support structure therefor may be mounted on platform 39. String clamp 92 is adapted to hold the cross-strings in a taut condition after an appropriate tension has been applied thereto.

Racket frame clamp assembly 24 includes racket frame clamps 94 and 114. Clamp 94 is adapted to clamp a racket onto the racket frame clamp assembly in the vicinity of the throat of the racket. Clamp 114 is adapted to clamp a racket to the assembly in the vicinity of the tip of the racket head.

The components of frame clamp 94 are best illustrated in FIG. 2. Clamp 94 includes a lower support 96 attached by any convenient means to support arm 40. A threaded bore 98 extends through support 96. A lower clamp jaw comprises a metal portion 100 to which is fastened a nylon, DuPont's DELRIN, or other polymeric plastic portion 102 mounted thereon. An upper clamp jaw comprises a metal portion 104 and an inner portion 106 made of nylon, DuPont's DELRIN, or other polymeric plastic material. Flanges are formed on the inner surfaces of the lower and upper clamp jaws so that the throat of the racket is restrained more positively from moving toward the center of the racket frame clamp assembly 24. While the lower jaw and upper jaw are illustrated as comprising backing metal pieces 100 and 104 and polymeric plastic inner pieces 102 and 106, the jaws may be formed entirely of one type of material, preferably a polymeric plastic material which will not mar or scratch the finish of the racket.

Clamp 94 also includes an internally threaded tube 108 having a smooth outer surface which passes through a bore in upper jaw 104, 106 and which is threaded into the threaded bore 98 in lower support 96. A handle 112 is used to turn a screw threaded within tube 108. Tube 108 has a smooth outer surface to prevent nicking or cutting of the string if it rubs against the screw portion of the clamp.

Tip clamp 114 is also best illustrated in FIG. 2. Clamp 114 comprises a lower support 116 having a threaded bore 118 extending therethrough. Two lower clamp jaws 120 are mounted for pivotable movement on support 116. Lower jaws 120 are mounted on opposite sides of the longitudinal axis of racket 11, preferably in the one o'clock and eleven o'clock positions, assuming that the throat clamp 94 is at the six o'clock position. Each of the lower jaws 120 has an upstanding flange 121 substantially at right angles to the main portion of the jaw 120 to hold the inner periphery of the racket and restrain it from movement toward the vertical axis of column 15 as tension is applied to the main strings.

A link 122 is pivotably mounted to lower support 116 by a pin 124 which acts as a pivot point. Link 122 is pivotably mounted to an upper support 128 by pin 126. In the illustrated embodiment, link 122 extends through an elongated slot best seen in FIG. 1 formed in upper support 128.

Upper jaw 132 is pivotably mounted on upper support 128 at a point equidistant between the two lower jaws 120. Thus, upper jaw 132 is preferably mounted in alignment with the longitudinal axis of racket 11. Upper jaw 132 includes a depending flange 133 to firmly retain the upper inner periphery of the racket from moving in a direction toward the vertical axis of column 15 when tension is applied to the main strings.

The clamp jaws 120 and 132 of clamp 114 are adaptable to firmly clamp the head portion of any type, shape or size racket having any radius of curvature. The structure of clamp 114 itself is novel and may be adapted for use on other types of racket stringing machines.

Clamp 114 also includes a threaded stud 134 which passes through slot 130 in upper support 128 and into threaded bore 118 in lower support 116. A compression spring 138 surrounds screw 134 to make it easy to unclamp the racket. A knob 136 travels up and down stud 134 to tighten and loosen the clamp jaws.

Jaws 120 and 132 may be made of single pieces of polymeric plastic, such as nylon or DuPont's DELRIN, which will not mar or scratch the racket frame. Alternately, jaws 120 and 132 may have a two piece construction with metal backing layers and inner polymeric plastic layers as described with respect to clamp 94.

Because of its construction, clamp 114 provides a novel clamping means for firmly holding a racket in place on the racket frame clamp assembly. The racket frame is held firmly but a minimal amount of frame flexure is allowed to compensate for the forces generated during stringing. In this way, areas of local stress along the racket head can be eliminated or minimized.

An important design feature of clamp 114 is that as the knob 136 is turned down on stud 134, upper jaw 132 travels in a downward arc as it contacts the racket frame so that the force vector exerted on the racket frame is down and toward the right as illustrated in FIG. 2. This is made possible by providing a link 122 slightly longer than the anticipated distance between the ends of lower support 116 and upper support 128 which carry the jaws 120 and 132 when a racket is clamped therebetween. Thus, clamp 114 provides for the important frame shape retention desirable in racket clamps. Clamp 114 will not snag or nick the string and provides maximum string hole access due to the dimensions of the clamp components.

In operation, the racket frame clamp assembly operates as follows. Lead screw 33 is turned so that support arms 40 and 49 are moved sufficiently toward the vertical axis of column 15 so that a racket frame can be easily clamped within previously loosened throat clamp 94 and tip clamp 114. A racket frame is placed upon the lower jaws of throat clamp 94 and tip clamp 114. If necessary, lead screw 33 is adjusted so that the flanges on the clamp jaws which prevent the inward distortion of the racket head are in contact with the inner periphery of the head of the frame. Clamps 94 and 114 are then tightened. Lead screw 33 is then turned so that the racket frame is slightly prestressed when support arms 40 and 49 move in a direction away from the vertical axis of column 15. This prestress compensates for the tremendous force exerted on the head of the partially strung racket as tension is applied to the string. The amount of prestress to be applied, if any, is based upon such factors as the shape of the racket head, the material from which the racket is made, the dimensions of the racket head, and other factors which must be empirically determined. String clamps 80 and 92 and their corresponding support structures may be mounted on platform 39 at any time and are used in a manner well known to those skilled in the art.

The preferred means for uniformly tensioning the racket string will now be described.

As set forth at the outset of this disclosure, one aspect of the present invention relates to a racket stringing apparatus in which continuous tension is applied and maintained on the racket strings as they are being strung by a driving device, rather than by a passive tensioning device, such as weights or springs. For the purposes of illustration and description, the presently preferred driving means is a pneumatic system due to its positive, efficient and uncomplicated mode of operation and manufacture. However, it should be understood that other driving devices such as those mentioned hereinbefore may be used and the modification of the present apparatus will be clear to those of ordinary skill in the art after considering the following description relating to the pneumatic system.

Figure 4:
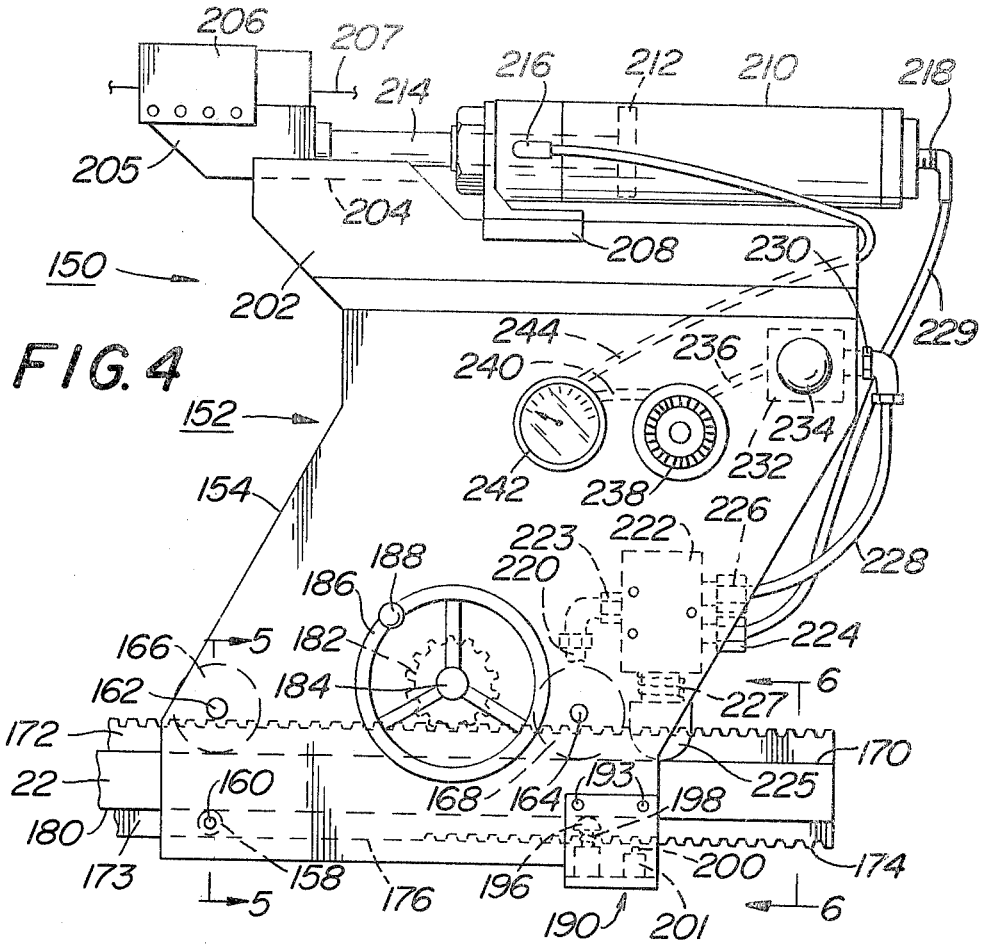
FIG. 4 is a side view of the tension head assembly of the racket stringing apparatus in a position prior to the tensioning of a string.
Figure 7:
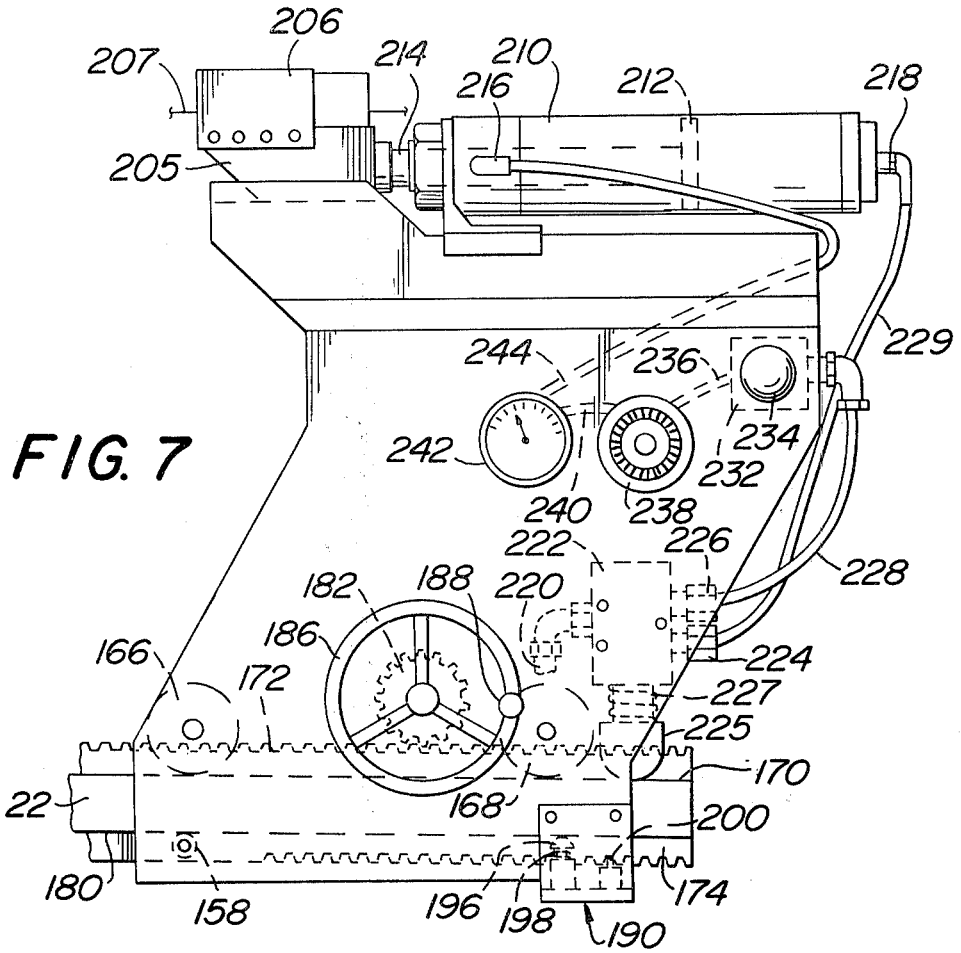
FIG. 7 is a side view of the tension head assembly similar to that illustrated in FIG. 4, but showing the tension head assembly in a position during the tensioning of the string.

Uniform application and maintenance of a predetermined string tension results from the use of tension head assembly 150, best illustrated in FIGS. 1 and 4 through 7. The left-hand side of FIGS. 4 and 7 are closest to the racket frame clamp assembly 24 as illustrated more particularly with reference to FIG. 1.

Figure 5:
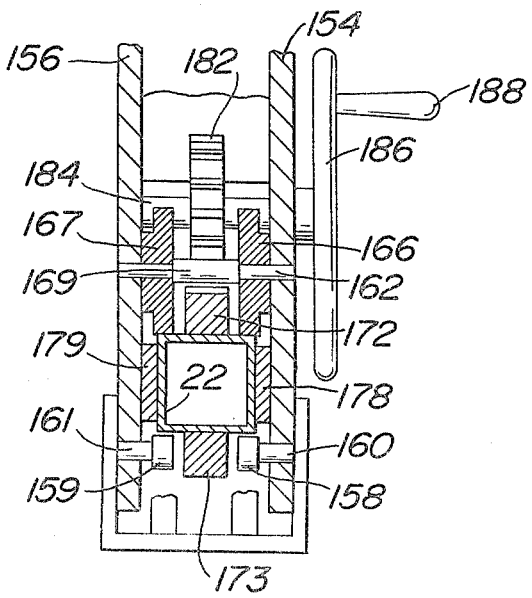
FIG. 5 is a cross-section view taken along lines 5—5 of FIG. 4.

Tension head assembly 150 includes a body 152 comprising side plates 154 and 156 spaced from and preferably parallel to each other. Body 152 is mounted for reciprocating movement along beam 22. As best illustrated in FIGS. 4 and 5, body 152 is supported on the upper surface 170 of beam 22 by two pairs of rollers. One pair of rollers 166 and 167 are mounted on a shaft 162 having a central portion 169 of a larger diameter. The shaft 162 is fastened to side plates 154 and 156. Another pair of rollers supports the righthand portion of body 152 as best illustrated in FIG. 4. Only one of the second pair of rollers is visible in the drawings, namely, roller 168 mounted on shaft 164.

To aid in the reciprocating movement of the tension head assembly along beam 22, a lower pair of rollers 158 and 159 are mounted on shafts 160 and 161, respectively. The shafts in turn are fastened to side plates 154 and 156, respectively. Rollers 158 and 159 are spaced a very slight distance from the lower surface 180 of beam 22 when the tension head assembly is in the orientation illustrated in FIG. 4. The very slight spacing is best illustrated in FIG. 5.

A rack 172 preferably is mounted on the top of beam 22 and a bar 173 is preferably mounted on the bottom of beam 22, although other equivalent arrangements are well within the knowledge of those of ordinary skill in the art. At least a portion of the lower surface of bar 173 contains teeth formed therein to constitute a rack. The purpose of rack 174 will be described hereinafter. Another portion of bar 173 may have a smooth surface 176 to lower the cost of manufacturing the bar.

A means for reciprocating the tension head assembly along the beam preferably comprises a pinion 182 mounted on shaft 184, which in turn is mounted for rotation in side plates 154 and 156. A hand wheel 186 is mounted on shaft 184 outside of body 152. Hand wheel 186 may include a crank pin 188. Pinion 182 cooperates with rack 172 to cause body 152 to move back and forth along beam 22. Mounted on the bottom right-hand portion of body 152 is a locking means 190, as illustrated in FIGS. 1, 4, 6 and 7. The locking means 190 is illustrated in a disengaged position in FIGS. 4 and 6. Locking means 190 is illustrated in an engaged position in FIG. 7. The purpose of the locking means is to selectively lock body 152 of tension head assembly 150 against any movement along beam 22 when the locking means is engaged under certain conditions to be described hereinafter.

Figure 6:
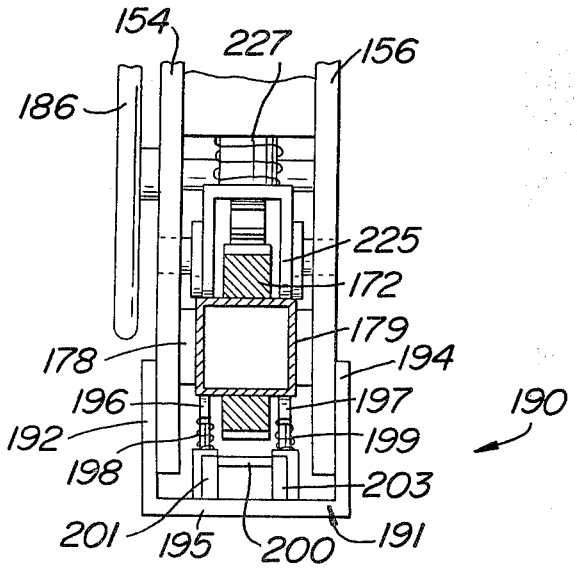
FIG. 6 is a partial section and partial end view taken along lines 6—6 of FIG. 4.

The components of locking means 190 are best illustrated in FIG. 6. Locking means 190 comprises a housing 191 having side plates 192 and 194 fastened by screws 193 or other suitable fasteners to side plates 154 and 156, respectively. Housing 191 also includes a bottom 195. The sides and bottom of housing 191 may be integrally formed or made of separate plates fastened together.

Telescoping pins 196 and 197 are mounted on bottom 195 of housing 191. Telescoping pins 196 and 197 may have any suitable head-shape, such as a round head, a half-moon shaped head, or the like which forms a spring seat for compression springs 198 and 199. The springs bear against the enlarged diameter of the bottom portion of pins 196 and 197.

Mounting lugs 201 and 203 are fastened to bottom 195 of housing 191. A locking bar or pin 200 extends between and is fastened to mounting lugs 201 and 203. Locking bar 200 is normally biased out of engagement with the teeth of rack 174 when there is no tension being applied to the string as best illustrated in FIG. 4. Locking bar 200 is shown engaged with rack 174 in FIG. 7.

Attached to the top portion of body 152 is a string gripper and cylinder support 202 mounted to side plates 154 and 156. A channel 204 is machined into or otherwise formed along the upper surface of support 202. A string gripper support block 205 reciprocates within channel 204 as best seen in FIGS. 1, 4 and 7.

Mounted on support block 205 is a string gripper of a type known as a snatch block gripper to those skilled in the art. One example of a suitable string gripper 206 is generally illustrated in FIG. 4 of U.S. Pat. No. 3,441,275 of Held, issued Apr. 29, 1969. The string gripper 206, per se, is not novel with the present invention, except as it cooperates with the remainder of tension head assembly 150.

Any suitable string gripper may be used with the present invention. Preferably, the string gripper 206 should be operative to grip string 207 when gripper 206 moves in a direction in which tension is applied to the string (toward the right-hand side of FIGS. 4 and 7).

A cylinder mount 208 is connected to support 202. A cylinder means 210 is fastened to mount 208. Although cylinder 210 is illustrated as having a housing which is cylindrical in cross-section, this is only one example of of suitable, presently preferred shape. Included within the cylinder is a piston 212 connected to one end of a piston rod 214. The other end of piston rod 214 extends out of the cylinder and is attached to string gripper support block 205. The coaxial orientation along the longitudinal axes of support block 205, piston rod 214 and cylinder 210 is the presently preferred embodiment. Other arrangements for the cylinder driving means may be used so long as support block 205 is driven for reciprocating movement within channel 204. As illustrated in FIG. 1, string gripper 206 is aligned with racket frame clamp assembly 24 so that the string may be threaded through the string holes of the racket frame with no or minimal friction contact.

Attached to cylinder 210 are fittings 216 and 218 to which fluid conduits are attachable.

The driving means for the illustrative pneumatic driving system includes a source of fluid pressure in the form of compressor 16 preferably attached to column 15. A control box 18 for actuating compressor 16 may also be mounted on column 15 in the vicinity of compressor 16. Control box 18 is connected to any suitable source of electricity, such as an alternating current source or a direct current source, such as a battery which may be associated with or independent of the base of the stringing machine.

A supply conduit 220 provides for the communication of pressurized air from compressor 16 to a valve means, such as four-way valve 222. Conduit 220 is connected to inlet fitting 223 on valve 222. Valve 222 includes an actuator 225 connected to a spool within the valve. Actuator 225 straddles rack 172 and is biased to be in constant contact with upper surface 170 of beam 22 by compression spring 227. A fitting 224 on valve 222 is connected by conduit 229 to fitting 218 on cylinder 210. Another fitting 226 on valve 222 is connected by conduit 228 to a fitting 230.

Fitting 230 connects to a valve means, such as three-way valve 232. A vent button 234 actuates the venting of three-way valve 232. Valve 232 is connected by conduit 236 to pressure regulator 238. Regulator 238 is connected by conduit 240 to an indicator 242. Indicator 242 in the presently preferred embodiment is a pressure gauge which is calibrated to correspond to and indicate the tension of the string 207 in pounds or kilograms. Any other suitable indicator for indicating string tension may be used. String tension is controlled by adjusting regulator 238 until gauge 242 indicates the predetermined tension. Gauge 242 is connected by conduit 244 to fitting 216 on cylinder 210.

The operation of tension head assembly 150 will now be explained.

The desired amount of tension is set by adjusting regulator 238 to the predetermined tension. Tension head assembly 150 is moved in a direction (toward the right-hand side of FIG. 4) to place an initial tension on string 207. When a sufficient initial tension is placed upon string 207, the entire tension head assembly 150 rotates in a counterclockwise direction around a transverse axis passing through shaft 162 for rollers 166 and 167. As an example, for stringing a tennis racket at a predetermined tension of about 75 pounds, the initial tension on the string to cause rotation of the tension head assembly is adjusted as described below to be about 20 pounds.

When tension head assembly 150 rotates about the transverse axis a sufficient amount, several simultaneous events occur. Locking means 190 prevents further movement of body 152 along beam 22. Simultaneously, valve 222 is actuated. This causes the simultaneous movement of piston 212, piston rod 214, string gripper support block 205 and string gripper 206 to apply and maintain the predetermined tension on string 207 until the string is clamped in the frame and the tension on the string applied by tension head assembly 150 can be released.

The tension applied to string 207 by tension head assembly 150 is released by pressing button 234 of three-way valve 232 to release the pressure on piston 212. The tension head assembly 150 then rotates in a clockwise direction around the transverse axis and the locking means is disengaged. The tension head assembly can then be moved in a direction toward the racket frame clamp assembly (toward the left-hand side of FIG. 7) to be in a position to again receive a string for tensioning.

String 207 is gripped by string gripper 206. At this point, string 207 is held only tightly enough to be retained by gripper 206 and tension head assembly 150 is in the orientation illustrated in FIG. 4. An operator moves hand wheel 86 in a clockwise direction as illustrated in FIG. 4 to cause pinion 182 to rotate and move to the right along rack 172. This causes tension head assembly body 152 to move toward the right from the position illustrated in FIG. 4 toward the position illustrated in FIG. 7.

Although pinion 182 presently is illustrated as being rotatable by hand wheel 186, it is contemplated that a power driving means, such as a belt, chain or gear means could connect a motor to pinion 182. Accordingly, the present invention is not limited to manually moving pinion 182, although that is the presently preferred embodiment because of its simplicity.

When the tension head assembly is in the position illustrated in FIG. 4, locking means 190 is not engaged with rack 174 so that body 152 may reciprocate along beam 22.

When the tension head assembly is in the position illustrated in FIG. 4, roller 168 is supported on upper surface 170 of beam 22. Actuator 225 for valve 222 rests upon upper surface 170 of beam 22 to maintain the spool within valve 222 in a condition whereby pressurized air is directed to fitting 218 to cause piston 212 to be toward the left end of cylinder 210 as illustrated in FIG. 4. In this condition, the air is forced under high pressures through fitting 224, conduit 229 and fitting 218 into the housing to force piston 212 to the left as illustrated in FIG. 4. Air is thus forced from in front of piston 212 through fitting 216, conduit 244, gauge 242, conduit 240, regulator 238, conduit 236 to a vent port (not illustrated for sake of clarity) in valve 232 to the atmosphere. If a driving means were a hydraulic system, rather than a pneumatic system, the venting port of three-way valve 232 could lead to a conduit and a reservoir connected by appropriate valving means to the source of pressurized liquid, such as a pump.

As body 152 moves toward the right as illustrated in FIG. 4 and as it approaches the position of FIG. 7, roller 160 rolls along the lower surface 180 of beam 22 and roller 168 is slightly lifted from the upper surface 170 of beam 22. As body 152 moves along beam 22 away from the racket frame clamp assembly 24 (toward the right-hand side of FIG. 4) tension will be applied to string 207.

When body 152 moves to the right from the position illustrated in FIG. 4 to the position illustrated in FIG. 7, a sufficient initial tension will be placed on string 207 to cause the entire tension head assembly 150 to have limited pivotable or rotational movement in a counterclockwise direction (as illustrated in FIGS. 4 and 7) about an axis transverse to beam 22 and transverse to the plane of the tension head assembly (parallel to side plates 154 and 156) adjacent a lower portion of body 152 through the axis of shaft 162.

After a sufficient initial tension is placed on string 207 to cause rotation of tension head assembly 150 in a counterclockwise direction as illustrated in FIG. 7, the force of compression springs 198 and 199 around telescoping pins 196 and 197 is overcome so that locking bar or pin 200 engages rack 174 to prevent further movement of body 152 along beam 22.

Simultaneously with the engagement of locking bar or pin 200 with rack 174, actuator 225 of valve 222 is activated by the expansion of compression spring 227 as tension head assembly 150 rotates counterclockwise.

The extent to which tension head assembly 150 is allowed to rotate depends upon the design characteristics of valve 222. In the presently preferred embodiment, as actuator 225 moves about 3/16 inch, the spool within the valve shifts between high pressure and low pressure positions. Accordingly, the distance between locking bar or pin 200 and its engaged position with rack 74 must be adjusted to correspond to the travel of the spool of valve 222.

The initial force necessary to cause counterclockwise rotation of tension head assembly 150 to initiate ultimate tensioning of the string may be adjusted by adjusting the force exerted by compression springs 198 and 199. Springs having different spring constants may be substituted, shims may be placed under pins 196 and 197 or the lower portion of telescoping pins 196 and 197 may be mounted on a vertically adjustable plate or bar (not illustrated) to adjust the compression of springs 198 and 199.

If the counterclockwise rotation occurs too early, that is, when a very small initial tension is placed on string 207, there will not be enough room within cylinder 210 for piston 212 to travel and the desired predetermined tension cannot be applied. The proper adjustment of springs 198 and 199 is easy to do once the desired ultimate amount of tension is determined. To avoid the potential problem of not having enough piston travel, the springs 198 and 199 should be adjusted to provide sufficient force so that tension head assembly 150 does not rotate to the locked position until an initial tension of about 20 percent of the ultimate preset tension is placed on the string. Most preferably, the initial tension to cause locking should be adjusted to be about 30 percent of the ultimate preset tension.

Simultaneously with the locking of body 152 against further movement along beam 22, valve 222 is actuated. When valve 222 is actuated, the valve spool shifts so that fluid flows from source 16 through valve 220, inlet fitting 223, valve 222, fitting 226, conduit 228, fitting 230, valve 232, conduit 236, regulator 238, conduit 240, gauge 242, conduit 244, and fitting 216 into cylinder 210 at a location to cause piston 212, piston rod 214, string block 205 and string gripper 206 to move toward the right as illustrated in FIG. 7. During the movement of the piston to the right, the flow path from fitting 218 to a vent port (not illustrated) in valve 222 is in a low pressure condition. If the driving means were a hydraulic system, rather than a pneumatic system, the vent port of valve 222 would be connected to a reservoir or a pump.

From the above description, it should be understood that even though body 152 of tension head assembly 150 is locked against movement along beam 22, string gripper support block 205 and string gripper 206 may still reciprocate due to the movement of piston 212 and piston rod 214. The amount of travel of gripper 206 depends upon the amount of tension desired on the string. String tension may be set by means of regulator 238.

Because the tensioning of the present invention includes a driving means, such as the pneumatic system previously described, any tendency of string 207 to elongate as it is being tightened is compensated for by additional movement of piston 212, piston rod 214, support block 205 and string gripper 206.

The present invention automatically compensates for string elongation during the tensioning process and controls the tensioning rate. This is important because the elongation of the string, which may be on the order of about 20 percent, can cause the tension to be reduced from the preset tension using prior art stringing machines. String elongation is a particular problem where prior art stringing machines have a tension braking mechanism, since the tension on the string cannot be increased to compensate for elongation after the brake is set.

One prior art solution was to pre-stretch the string by overtensioning it and allowing it to contract. The overtensioning process may cause premature string breakage and adds another step to the stringing process.

These problems are overcome by using the present invention. The tension is applied to and maintained on the string even as it elongates at a controlled rate. This does not over stress the string so that the string remains resilient longer.

When it is desired to release the tension on the string after the string has been clamped in the frame by string clamps 80 or 92, the operator pushes button 234 of three-way valve 232 which vents the air from the left portion of cylinder 210 through fitting 216, conduit 244, gauge 242, conduit 240, regulator 238, conduit 236 and out through a vent port (not illustrated) in valve 232. Valve 222 is then deactivated to the condition previously described and, since the tension on string 207 is released, tension head assembly 150 is urged to rotate in a clockwise direction around the transverse axis through shaft 162 of rollers 166 and 167 by compression springs 198 and 199 so that locking bar or pin 200 disengages from rack 174. After the disengagement of the locking bar or pin 220 from rack 174, tension head assembly 150 may be moved to the left from the position illustrated in FIG. 7 to the position illustrated in FIG. 4. The assembly is then ready to tension the string after it has been inserted through another pair of string holes.

The present invention may be embodied in other specific embodiments without departing from the spirit or essential attributes thereof and, accordingly, reference should be made to the appended claims, rather than to the foregoing specification, as indicating the scope of the invention.

I claim:

1. A racket stringing apparatus comprising:

(a) a base, (b) a racket frame clamp assembly pivotably mounted on the base and adapted to clamp a racket to be strung, (c) a tension head support beam having a first end and a second end, the first end of the beam being mounted on the base, (d) a tension head assembly mounted for reciprocating movement along the beam and for limited pivotable movement about an axis transverse to the beam and transverse to the plane of the tension head assembly and adjacent a lower portion of the tension head assembly closest to the first end of the beam, (e) driving means for continuously maintaining a predetermined final tension on a string with which the racket is to be strung, the driving means being activated by an actuator means which is activated upon sensing a predetermined initial string tension, (f) means for regulating the tension on a string, and (g) means for indicating the tension on the string, the tension head assembly including a body, means for reciprocating the tension head assembly along the beam, locking means for locking the tension head assembly against movement along the beam, string gripping means mounted for reciprocating movement along a top portion of the body, the string gripping means being connected to the driving means, whereby when a sufficient initial tension is placed on the string held in the string gripping means as the body is moved in a direction toward the second end of the beam by the means for reciprocating the tension head assembly, the tension head assembly pivots about the transverse axis in a direction toward the first end of the beam, the pivoting simultaneously causing the locking means to interact with the beam to prevent reciprocating movement of the tension head assembly along the beam and the pivoting further simultaneously causing the actuator means to activate the driving means to apply and maintain the predetermined final tension on the string until the driving means is deactivated.

2. Racket stringing apparatus according to claim 1 wherein the driving means comprises a fluid driving means.

3. Racket stringing apparatus according to claim 2 further comprising fluid cylinder means associated with the fluid driving means and mounted on the top portion of the body comprising a cylinder housing, a piston within the housing and a piston rod attached at one end to the piston and at the other end to the string gripping means.

4. Racket stringing apparatus according to claim 1 or 3 wherein the driving means comprises a pneumatic driving means.

5. Racket stringing apparatus according to claim 3 wherein the fluid driving means includes a source of pressurized fluid communicating through actuator means to the fluid cylinder means, whereby the actuator means is activated by the pivoting of the tension head assembly in a direction toward the first end of the beam, which causes fluid to flow into a first portion of the cylinder means which will apply and maintain the predetermined final tension on the string until the driving means is deactivated.

6. Racket stringing apparatus according to claim 5 wherein the actuator means controls a valve means including an inlet and first and second ports, such that when the actuator is activated to maintain the first port in a high pressure condition and the second port in a low pressure condition the fluid flows through conduits, the means regulating the tension of the string and the means for indicating the tension on the string to the first portion of the cylinder means, and wherein when the driving means is deactivated, the actuator is biased to maintain the first port in a low pressure condition and the second port in a high pressure condition to thereby direct the fluid through a conduit to a second portion of the cylinder means and the fluid in the first portion of the cylinder means is vented causing the string gripping means to extend in a direction toward the first end of the beam when the tension head assembly pivots toward the second end of the beam.

7. Racket stringing apparatus according to claim 1 wherein the means for reciprocating the tension head assembly along the beam comprises a pinion mounted on the body, means to rotate the pinion mounted on the body and rack means with which the pinion cooperates mounted on the beam at least along a portion of the beam.

8. Racket stringing apparatus according to claim 1 wherein the locking means comprises a locking bar fastened to a bottom portion of the tension head assembly closest to the second end of the beam, the locking bar being engageable with a rack means mounted on the beam along at least a portion of the length of the beam when the tension head pivots in a direction toward the first end of the beam.

9. Racket stringing apparatus according to claim 8 wherein the locking bar is normally biased out of engagement with the rack means when the driving means is deactivated.

10. Racket stringing apparatus according to claim 1 wherein the racket frame clamp assembly includes a support member mounted for pivotable movement about the vertical axis of the base, support arms mounted on elongated bars for relative reciprocating movement along the length of the bars, frame clamp means mounted on the support arms and self-centering means operatively associated with the support arms to cause the frame clamp means to be self-centering with respect to the vertical axis.

11. Racket stringing apparatus according to claim 10 wherein the self-centering means comprises a right-hand threaded bore extending through a bottom portion of one support arm, a left-hand threaded bore extending through a bottom portion of the other support arm, and a lead screw extending along the length of the bars, the lead screw having a reduced diameter at its center which is maintained in alignment with the vertical axis of the base corresponding to the center of a head of the racket to be strung, one end of the lead screw having a right-hand thread extending through the right-hand threaded bore of the one support arm, the other end of the lead screw having a left-hand thread extending through the left-hand threaded bore of the other support arm, whereby when the lead screw is turned in one direction the support arms move the same distance in a direction toward the vertical axis and when the lead screw is turned in the opposite direction, the support arms move the same distance in a direction away from the vertical axis.

12. Racket stringing apparatus according to claim 1 wherein the racket frame clamp assembly includes a racket frame throat clamp adapted to clamp a racket to be strung adjacent a throat portion of the racket and a racket frame head clamp adapted to clamp a head portion of the racket to be strung adjacent a tip portion of the racket, the racket frame head clamp comprising two lower jaws mounted on one end of a lower jaw support having two ends, the lower jaws being spaced apart from each other and adapted to hold the head portion of the racket along its lower inner periphery at locations on opposite sides of the longitudinal axis of the racket, an upper jaw mounted on one end of an upper jaw support having two ends and adapted to hold the head portion of the racket at a location along its upper inner periphery equidistant between the lower jaws, a link having two ends, one end of the link being pivotably connected to the other end of the lower jaw support, the other end of the link being pivotably connected to the other end of the upper jaw support, and screw means associated with the upper and lower jaw supports and intermediate the ends thereof operative to move the upper jaw toward the lower jaws to clamp the racket head firmly therebetween.

13. Racket stringing apparatus according to claim 12 wherein the jaws are mounted for rotation about their central axes perpendicular to the plane of the jaw supports.

14. A racket stringing apparatus comprising:

a base;

a racket frame clamp assembly adapted to clamp a racket to be strung, the racket frame clamp assembly being mounted for rotation about a vertical axis of the base, the racket frame clamp assembly including a support member pivotably mounted to the base, two support arms mounted on elongated bars for relative reciprocating movement along the length of the bars, frame clamp means mounted on the support arms and self-centering means operatively associated with the support arms to cause the frame clamp means to be self-centering with respect to the vertical axis;

a tension head support beam having a first end and a second end, the first end of the beam being mounted on the base;

a tension head assembly mounted for reciprocating movement along the beam and for limited pivotable movement about an axis transverse to the beam and transverse to the plane of the tension head assembly and adjacent a lower portion of the tension head assembly closest to the first end of the beam, the tension head assembly including a body, means for reciprocating the tension head assembly along the beam, locking means for selectively interacting with the beam for locking the tension head assembly against movement along the beam, and string gripping means mounted for reciprocating movement along a top portion of the body;

a fluid driving means for applying and continuously maintaining a predetermined final tension on a string with which the racket is to be strung, the fluid driving means comprising a fluid cylinder means mounted on the top portion of the body, the fluid cylinder means including a cylinder housing, a piston within the housing and a piston rod attached at one end to the piston and at the other end to the string gripping means, a source of pressurized fluid in communication with the cylinder means, actuating means for selectively causing reciprocating movement of the piston within the cylinder housing by controlling the flow of the pressurized fluid when the actuator means is activated upon sensing a predetermined initial string tension;

a pressure regulating means for regulating the flow of fluid to the cylinder housing which in turn regulates the tension on the string, and an indicating means for indicating the tension on the string;

the components being in a cooperating relationship wherein the locking means is normally disengaged and does not interact with the beam to allow the tension head assembly to reciprocate, and upon movement of the tension head assembly toward the second end of the beam by the means for reciprocating the tension head assembly, sufficient initial tension is placed on a string held by the string gripping means to cause the tension head assembly to pivot about the transverse axis in a direction toward the first end of the beam and the pivoting simultaneously causing the locking means to interact with the beam to prevent movement of the body with respect to the beam and the pivoting further simultaneously causing the actuating means to be activated thereby causing the fluid to flow to a portion of the cylinder housing to apply and continuously maintain the predetermined final tension on the string.

15. Racket stringing apparatus according to claim 14 wherein the fluid is air and wherein the source of the pressurized fluid is an air compressor mounted on the base.

16. Racket stringing apparatus according to claim 14 wherein the means for reciprocating the tension head assembly along the beam comprises a pinion mounted on the body, including means to rotate the pinion, and rack means with which the pinion cooperates mounted on the top of the beam at least along a portion of the beam.

17. Racket stringing apparatus according to claim 14 wherein the locking means comprises a locking pin fastened to a bottom portion of the tension head assembly closest to the second end of the beam, the locking pin being engageable into a rack means mounted on the bottom of the beam along at least a portion of the length of the beam when the tension head assembly pivots toward the first end of the beam.

18. Racket stringing apparatus according to claim 14 wherein the self-centering means comprises a right-hand threaded bore extending through a bottom portion of the one support arm, a left-hand threaded bore extending through a bottom portion of the other support arm, and a lead screw extending along the length of the bars, the lead screw having a reduced diameter at its center which is maintained in alignment with the vertical axis of the base corresponding to the center of a head of the racket to be strung, one end of the lead screw having a right-hand thread extending through the right-hand threaded bore of the one support arm, the other end of the lead screw having a left-hand thread extending through the left-hand threaded bore of the other support arm, whereby when the lead screw is turned in one direction the support arms move the same distance in a direction toward the vertical axis and when the lead screw is turned in the opposite direction, the support arms move the same distance in a direction away from the vertical axis.

19. Racket stringing apparatus according to claim 18 wherein each of the support arms are mounted between two elongated bars, the elongated bars to which the one support arm is mounted having interlocking means to interlock with cooperating interlocking means of the elongated bars to which the other support arm is mounted.

20. Racket stringing apparatus according to claim 19 wherein the interlocking means comprise ways formed in the bars, the ways having cross-sections comprising a V shape and an inverted V shape, respectively.

21. Racket stringing apparatus according to claim 14 wherein the racket frame clamp assembly includes a racket frame throat clamp adapted to clamp a racket to be strung adjacent a throat portion of the racket and a racket frame head clamp adapted to clamp a head portion of the racket to be strung adjacent a tip portion of the racket, the racket frame head clamp comprising two lower jaws mounted on one end of a lower jaw support having two ends, the lower jaws being spaced apart from each other and adapted to hold the head portion of the racket along its lower inner periphery at locations on opposite sides of the longitudinal axis of the racket, an upper jaw mounted on one end of an upper jaw support having two ends and adapted to hold the head portion of the racket at a location along its upper inner periphery equidistant between the lower jaws, a link having two ends, one end of the link being pivotably connected to the other end of the lower jaw support, the other end of the link being pivotably connected to the other end of the upper jaw support, and screw means associated with the upper and lower jaw supports and intermediate the ends thereof operative to move the upper jaw toward the lower jaws to clamp the racket head firmly therebetween.

22. Racket stringing apparatus according to claim 14 wherein the jaws are mounted for rotation about their central axes perpendicular to the plane of the jaw supports.

* * * * *